US005930459A

United States Patent [19]

Eckman et al.

[11] Patent Number: 5,930,459

[45] **Date of Patent: *Jul. 27, 1999**

[54] IMMERSION HEATING ELEMENT WITH HIGHLY THERMALLY CONDUCTIVE POLYMERIC COATING

[75] Inventors: Charles M. Eckman, Dallas, Pa.; James S. Roden, Montgomery, Ala.; Arie Hochberg, Rosemont, Pa.

[73] Assignees: Energy Converters, Inc., Dallas, Pa.; Rheem Manufacturing Co, New York, N.Y.

[ * ] Notice: This patent is subject to a terminal disclaimer.

[21] Appl. No.: 08/767,156

[22] Filed: Dec. 16, 1996

Related U.S. Application Data

[63] Continuation-in-part of application No. 08/365,920, Dec. 29, 1994, Pat. No. 5,586,214, and application No. 08/755,836, Nov. 26, 1996.

[51] Int. Cl.[6] ..... H05B 3/78; H05B 3/28

[52] U.S. Cl. ..... 392/503; 392/500; 219/523; 219/544

[58] Field of Search ..... 392/500, 501, 392/503; 338/315, 316, 318, 290, 286, 58; 219/546, 548, 552, 553, 540, 530, 544

[56] References Cited

U.S. PATENT DOCUMENTS

| | | | |
|---|---|---|---|
| 1,043,922 | 11/1912 | Gold | 219/523 |
| 2,146,402 | 2/1939 | Morgan | 219/523 |
| 2,846,536 | 8/1958 | Drugmand | 219/501 |
| 3,614,386 | 10/1971 | Hepplewhite | 219/312 |
| 3,621,566 | 11/1971 | Welsh | 29/610 |
| 3,683,361 | 8/1972 | Salzwedel | 338/322 |
| 3,860,787 | 1/1975 | Strobach | 219/336 |
| 3,927,300 | 12/1975 | Wada et al. | 219/381 |
| 3,943,328 | 3/1976 | Cunningham | 219/335 |
| 3,952,182 | 4/1976 | Flanders | 219/309 |
| 4,272,673 | 6/1981 | Semanaz et al. | 219/544 |
| 4,326,121 | 4/1982 | Welsby et al. | 219/523 |
| 4,354,096 | 10/1982 | Dumas | 219/523 |
| 4,436,988 | 3/1984 | Blumenkranz | 219/544 |
| 4,617,456 | 10/1986 | Richards | 392/503 |
| 4,687,905 | 8/1987 | Cunningham et al. | 219/336 |
| 4,707,590 | 11/1987 | Lefebvre | 219/523 |
| 5,013,890 | 5/1991 | Gamble | 392/497 |
| 5,129,033 | 7/1992 | Ferrara et al. | 392/447 |
| 5,155,800 | 10/1992 | Rezabek et al. | 382/503 |
| 5,159,659 | 10/1992 | Cameron | 392/503 |
| 5,305,419 | 4/1994 | Cameron | 392/503 |
| 5,371,830 | 12/1994 | Wachenheim | 392/503 |
| 5,586,214 | 12/1996 | Eckman | 392/503 |

FOREIGN PATENT DOCUMENTS

| | | |
|---|---|---|
| 35 12 659 | 10/1986 | Germany . |
| 3512659 | 10/1986 | Germany . |
| 38 36 387 C1 | 4/1990 | Germany . |
| 53-134245 | 11/1978 | Japan . |
| 3-129694 | 6/1991 | Japan . |
| 14562 | 9/1913 | United Kingdom . |
| 1070849 | 6/1967 | United Kingdom . |
| 2244898 | 12/1991 | United Kingdom . |

OTHER PUBLICATIONS

"Polymers", *Guide to Selecting Engineered Materials,* a special issue of Advanced Materials & Processes, Metals Park, OH, ASM International, 1989, pp. 92–93.

"Makroblend Polycarbonate Blend, Tedur Polyphenylene Sulfide", *Machine Design: Basics of Design Engineering,* Cleveland, OH, Penton Publishing, Inc., Jun. 1991, pp. 820–821, 863, 866–867.

*Primary Examiner*—Teresa Walberg
*Assistant Examiner*—Thor S. Campbell
*Attorney, Agent, or Firm*—Duane Morris & Heckscher LLP

[57] ABSTRACT

Electrical resistance heating elements are provided which are useful in heating fluid mediums, such as air and water. The heating elements include an element body having a supporting surface and a resistance wire wound onto the supporting surface which is connected to a pair of terminal end portions. Disposed over the resistance wire, and over most of the supporting surface, is a thermally-conductive polymeric coating which hermetically encapsulates and electrically insulates the resistance wire from the fluids to be heated. This thermally-conductive polymer coating has a thermal conductivity value of at least about 0.5 W/m °K. Improved properties are preferably provided by ceramic powder, such as $Al_2O_3$ and MgO, and glass fiber additives.

25 Claims, 7 Drawing Sheets

HEATING ELEMENT 100

IMMERSION HEATING ELEMENT WITH HIGHLY THERMALLY CONDUCTIVE POLYMERIC COATING

CROSS REFERENCE TO RELATED APPLICATIONS

This application is a continuation-in-part of U.S. patent application Ser. No. 08/365,920 filed Dec. 29, 1994, and entitled "Immersion Heating Element With Electric Resistance Heating Material and Polymeric Layer Disposed Thereon", now U.S. Pat. No. 5,586,214.

This application is also a continuation-in-part of U.S. patent application Ser. No. 09/755,836, filed on Nov. 26, 1996, and entitled "Improved Polymeric Immersion Heating Element With Skeletal Support and Optional Heat Transfer Fins".

FIELD OF THE INVENTION

This invention relates to electric resistance heating elements, and more particularly, to polymer-containing resistance heating elements for heating gases and liquids.

BACKGROUND OF THE INVENTION

Electric resistance heating elements used in connection with water heaters have traditionally been made of metal and ceramic components. A typical construction includes a pair of terminal pins brazed to the ends of an Ni—Cr coil, which is then disposed axially through a U-shaped tubular metal sheath. The resistance coil is insulated from the metal sheath by a powdered ceramic material, usually magnesium oxide.

While such conventional heating elements have been the workhorse for the water heater industry for decades, there have been a number of widely-recognized deficiencies. For example, galvanic currents occurring between the metal sheath and any exposed metal surfaces in the tank can create corrosion of the various anodic metal components of the system. The metal sheath of the heating element, which is typically copper or copper alloy, also attracts lime deposits from the water, which can lead to premature failure of the heating element. Additionally, the use of brass fittings and copper tubing has become increasingly more expensive as the price of copper has increased over the years.

As an alternative to metal elements, at least one plastic sheath electric heating element has been proposed in Cunningham, U.S. Pat. No. 3,943,328. In the disclosed device, conventional resistance wire and powdered magnesium oxide are used in conjunction with a plastic sheath. Since this plastic sheath is non-conductive, there is no galvanic cell created with the other metal parts of the heating unit in contact with the water in the tank, and there is also no lime buildup. Unfortunately, for various reasons, these prior art, plastic-sheath heating elements were not capable of attaining high wattage ratings over a normal useful service life, and concomitantly, were not widely accepted.

SUMMARY OF THE INVENTION

This invention provides electrical resistance heating elements for use in connection with heating fluid mediums, such as air and water. These elements include an element body having a supporting surface thereon and a resistance wire wound onto the supporting surface and connected to at least a pair of terminal end portions of the element. Disposed over the resistance wire and supporting surface is a thermally-conductive polymeric coating which forms a hermetic seal around the resistance wire. The thermally-conductive polymeric coating has a thermal conductivity value of at least about 0.5 W/m °K.

The heating elements of this invention are designed to provide multiple wattage ratings from 1000 W to about 6000 W and beyond. For gas heating, these elements can provide lower wattages of less than about 1200W. The improved thermally-conductive polymer coatings of this invention provide thermal conductivity values which permit greatly improved heat dissipation from resistance wire. This property enables the disclosed elements to provide efficient fluid heating without melting the relatively thin polymeric coatings. Loadings within the range of about 60–200 parts of ceramic material per 100 parts of resin in the polymer coating are preferred. The lower limit is set by the amount of thermal conductivity necessary to heat fluids, and the higher limit is set so as to provide for easier molding of these elements by standard processing, such as by injection molding. Fibrous reinforcement has also been helpful in providing mechanical strength to the polymeric coating so as to resist cracking and deformation during cyclical thermal loads, such as those experienced in a water heater.

In additional embodiments of this invention, the improved thermally conductive polymeric coatings are applied to conventional, metal sheathed elements for reducing galvanic corrosion in water heaters without substantially interfering with liquid heating efficiency.

A BRIEF DESCRIPTION OF THE DRAWINGS

The accompanying drawings illustrate preferred embodiments of the invention, as well as other information pertinent to the disclosure, in which:

FIG. 1: is a perspective view of a preferred polymeric fluid heater of this invention;

FIG. 2: is a left side, plan view of the polymeric fluid heater of FIG. 1;

FIG. 3: is a front planar view, including partial cross-sectional and peel-away views, of the polymeric fluid heater of FIG. 1;

FIG. 4: is a front planar, cross-sectional view of a preferred inner mold portion of the polymeric fluid heater of FIG. 1;

FIG. 5: is a front planar, partial cross-sectional view of a preferred termination assembly for the polymeric fluid heater of FIG. 1;

FIG. 6: is a enlarged partial front planar view of the end of a preferred coil for a polymeric fluid heater of this invention; and FIG. 7: is a enlarged partial front planar view of a dual coil embodiment for a polymeric fluid heater of this invention;

FIG. 8: is a front perspective view of a preferred skeletal support frame of the heating element of this invention;

FIG. 9: is an enlarged partial view of the preferred skeletal support frame of FIG. 8, illustrating a deposited thermally-conductive polymeric coating;

FIG. 10: is an enlarged cross-sectional view of an alternative skeletal support frame;

FIG. 11: is a side plan view of the skeletal support frame of FIG. 10;

FIG. 12: is a front plan view of the full skeletal support frame of FIG. 10; and FIG. 13: is a cross-sectional side view of an improved metal sheathed element equipped with a thermally conductive polymer coating of this invention.

DETAILED DESCRIPTION OF THE INVENTION

This invention provides electrical resistance heating elements and water heaters containing these elements. These devices are useful in minimizing galvanic corrosion within water and oil heaters, as well as lime buildup and problems of shortened element life. As used herein, the terms "fluid" and "fluid medium" apply to both liquids and gases.

Figure 1:
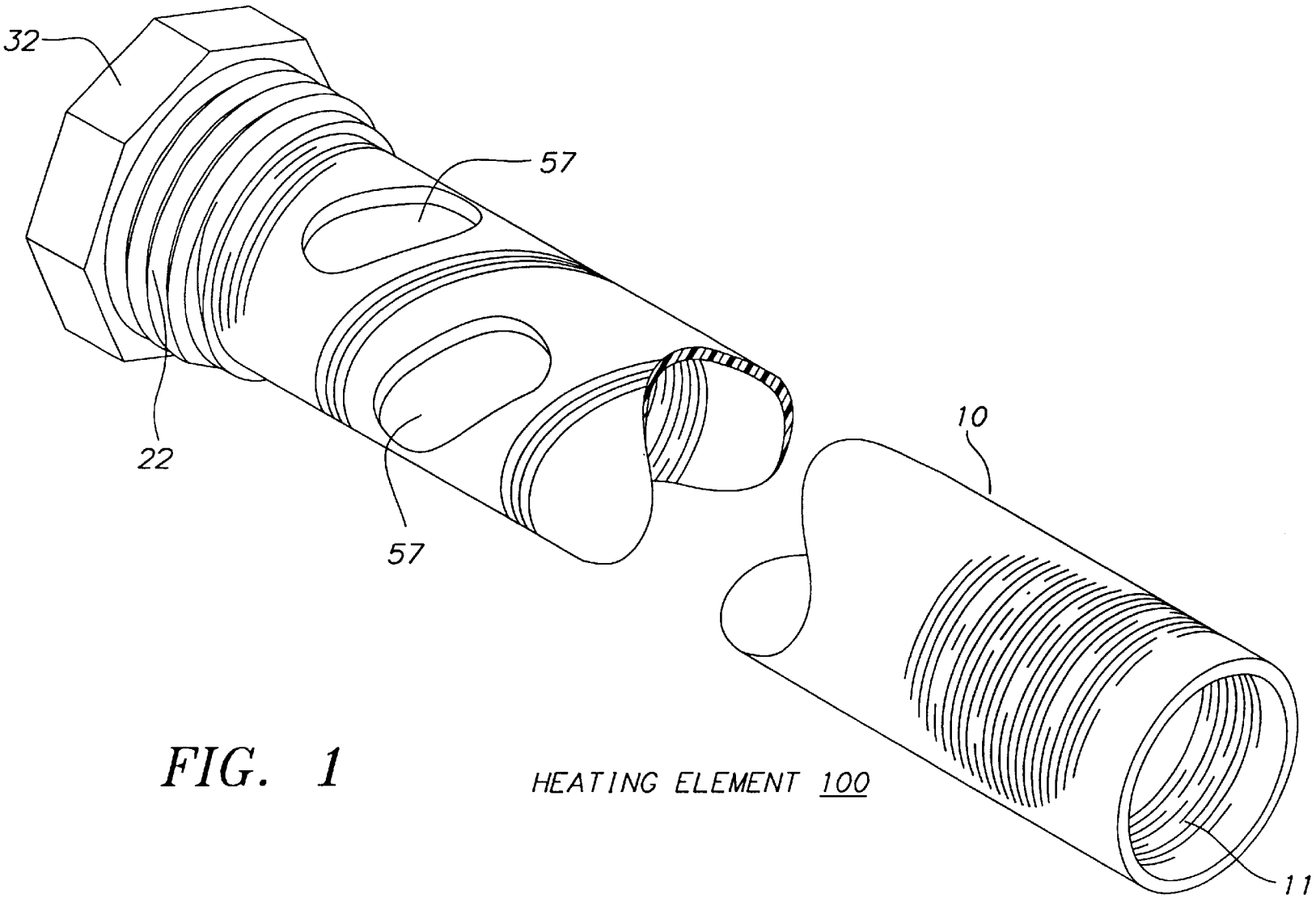
Figure 2:
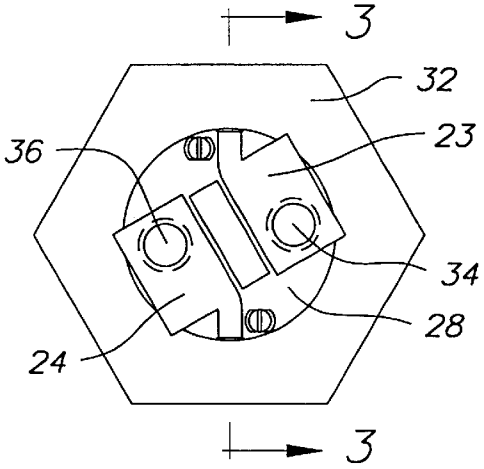
Figure 3:
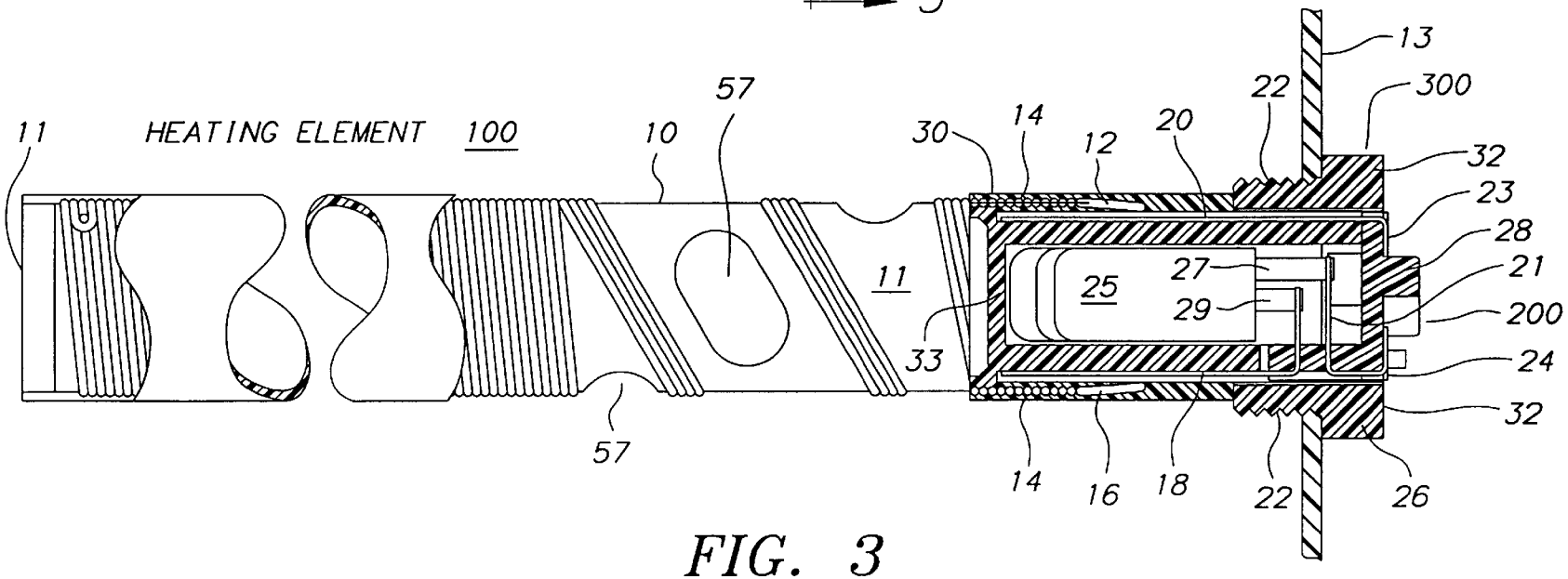

With reference to the drawings, and particularly with reference to FIGS. 1–3 thereof, there is shown a preferred polymeric fluid heater 100 of this invention. The polymeric fluid heater 100 contains an electrically conductive, resistance heating material. This resistance heating material can be in the form of a wire, mesh, ribbon, or serpentine shape, for example. In the preferred heater 100, a coil 14 having a pair of free ends joined to a pair of terminal end portions 12 and 16 is provided for generating resistance heating. Coil 14 is hermetically and electrically insulated from fluid with an integral layer of a high temperature polymeric material. In other words, the active resistance heating material is protected from shorting out in the fluid by the polymeric coating. The resistance material of this invention is of sufficient surface area, length or cross-sectional thickness to heat water to a temperature of at least about 120° F. without melting the polymeric layer. As will be evident from the below discussion, this can be accomplished through carefully selecting the proper materials and their dimensions.

Figure 4:
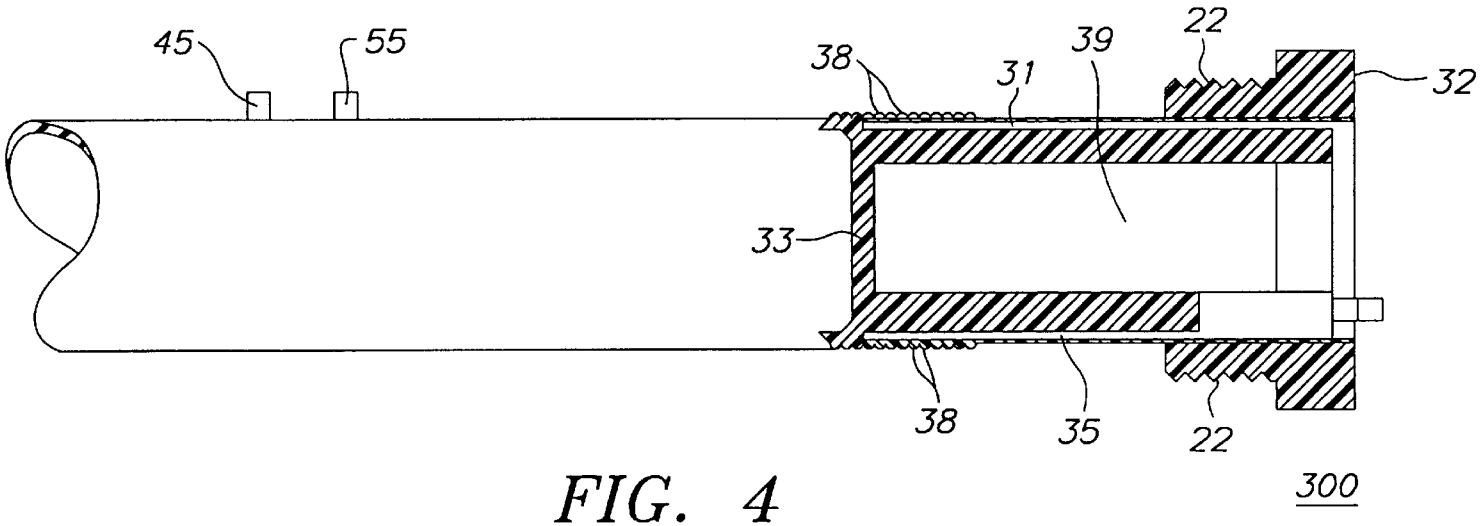
Figure 5:
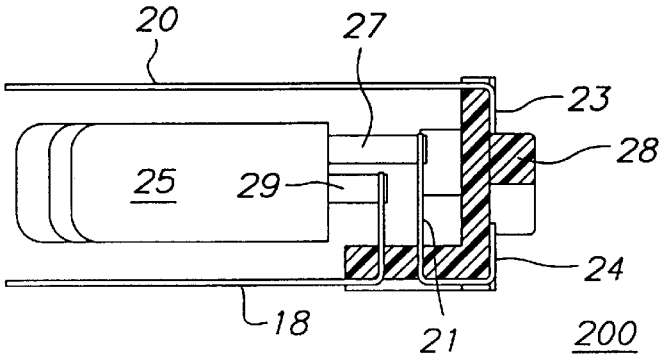

With reference to FIG. 3 in particular, the preferred polymeric fluid heater 100 generally comprises three integral parts: a termination assembly 200, shown in FIG. 5, a inner mold 300, shown in FIG. 4, and a polymeric coating 30. Each of these subcomponents, and their final assembly into the polymeric fluid heater 100 will now be further explained.

The preferred inner mold 300, shown in FIG. 4, is a single-piece injection molded component made from a high temperature polymer. The inner mold 300 desirably includes a flange 32 at its outermost end. Adjacent to the flange 32 is a collar portion having a plurality of threads 22. The threads 22 are designed to fit within the inner diameter of a mounting aperture through the sidewall of a storage tank, for example in a water heater tank 13. An O-ring (not shown) can be employed on the inside surface of the flange 32 to provide a surer water-tight seal. The preferred inner mold 300 also includes a thermistor cavity 39 located within its preferred circular cross-section. The thermistor cavity 39 can include an end wall 33 for separating the thermistor 25 from fluid. The thermistor cavity 39 is preferably open through the flange 32 so as to provide easy insertion of the termination assembly 200. The preferred inner mold 300 also contains at least a pair of conductor cavities 31 and 35 located between the thermistor cavity and the outside wall of the inner mold for receiving the conductor bar 18 and terminal conductor 20 of the termination assembly 200. The inner mold 300 contains a series of radial alignment grooves 38 disposed around its outside circumference. These grooves can be threads or unconnected trenches, etc., and should be spaced sufficiently to provide a seat for electrically separating the helices of the preferred coil 14.

The preferred inner mold 300 can be fabricated using injection molding processes. The flow-through cavity 11 is preferably produced using a 12.5 inch long hydraulically activated core pull, thereby creating an element which is about 13–18 inches in length. The inner mold 300 can be filled in a metal mold using a ring gate placed opposite from the flange 32. The target wall thickness for the active element portion 10 is desirably less than 0.5 inches, and preferably less than 0.1 inches, with a target range of about 0.04–0.06 inches, which is believed to be the current lower limit for injection molding equipment. A pair of hooks or pins 45 and 55 are also molded along the active element development portion 10 between consecutive threads or trenches to provide a termination point or anchor for the helices of one or more coils. Side core pulls and an end core pull through the flange portion can be used to provide the thermistor cavity 39, flow-through cavity 11, conductor cavities 31 and 35, and flow-through apertures 57 during injection molding.

With reference to FIG. 5, the preferred termination assembly 200 will now be discussed. The termination assembly 200 comprises a polymer end cap 28 designed to accept a pair of terminal connections 23 and 24. As shown in FIG. 2, the terminal connections 23 and 24 can contain threaded holes 34 and 36 for accepting a threaded connector, such as a screw, for mounting external electrical wires. The terminal connections 23 and 24 are the end portions of terminal conductor 20 and thermistor conductor bar 21. Thermistor conductor bar 21 electrically connects terminal connection 24 with thermistor terminal 27. The other thermistor terminal 29 is connected to thermistor conductor bar 18 which is designed to fit within conductor cavity 35 along the lower portion of FIG. 4. To complete the circuit, a thermistor 25 is provided. Optionally, the thermistor 25 can be replaced with a thermostat, a solid-state TCO or merely a grounding band that is connected to an external circuit breaker, or the like. It is believed that the grounding band (not shown) could be located proximate to one of the terminal end portions 16 or 12 so as to short-out during melting of the polymer.

In the preferred environment, thermistor 25 is a snap-action thermostat/thermoprotector such as the Model W Series sold by Portage Electric. This thermoprotector has compact dimensions and is suitable for 120/240 VAC loads. It comprises a conductive bi-metallic construction with an electrically active case. End cap 28 is preferably a separate molded polymeric part.

After the termination assembly 200 and inner mold 300 are fabricated, they are preferably assembled together prior to winding the disclosed coil 14 over the alignment grooves 38 of the active element portion 10. In doing so, one must be careful to provide a completed circuit with the coil terminal end portions 12 and 16. This can be assured by brazing, soldering or spot welding the coil terminal end portions 12 and 16 to the terminal conductor 20 and thermistor conductor bar 18. It is also important to properly locate the coil 14 over the inner mold 300 prior to applying the polymer coating 30. In the preferred embodiment, the polymer coating 30 is overmolded to form a thermoplastic polymeric bond with the inner mold 300. As with the inner mold 300, core pulls can be introduced into the mold during the molding process to keep the flow-through apertures 57 and flow-through cavity 11 open.

Figure 6:
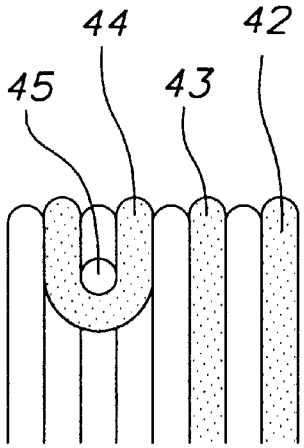
Figure 7:
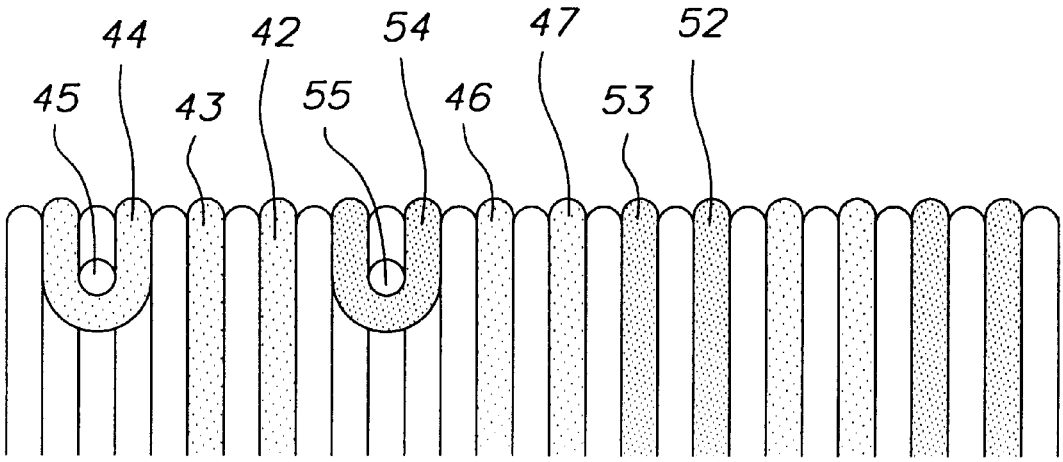

With respect to FIGS. 6 and 7, there are shown single and double resistance wire embodiments for the polymeric resistance heating elements of this invention. In the single wire embodiment shown in FIG. 6, the alignment grooves 38 of the inner mold 300 are used to wrap a first wire pair having helices 42 and 43 into a coil form. Since the preferred embodiment includes a folded resistance wire, the end portion of the fold or helix terminus 44 is capped by folding it around pin 45. Pin 45 ideally is part of, and injection molded along with, the inner mold 300.

Similarly, a dual resistance wire configuration can be provided. In this embodiment, the first pair of helices 42 and 43 of the first resistance wire are separated from the next consecutive pair of helices 46 and 47 in the same resistance wire by a secondary coil helix terminus 54 wrapped around a second pin 55. A second pair of helices 52 and 53 of a second resistance wire, which are electrically connected to the secondary coil helix terminus 54, are then wound around the inner mold 300 next to the helices 46 and 47 in the next adjoining pair of alignment grooves. Although the dual coil assembly shows alternating pairs of helices for each wire, it is understood that the helices can be wound in groups of two or more helices for each resistance wire, or in irregular numbers, and winding shapes as desired, so long as their conductive coils remain insulated from one another by the inner mold, or some other insulating material, such as separate plastic coatings, etc.

The plastic parts of this invention, such as the polymeric coating 30, skeletal support frame 70 and inner mold 300, preferably include a "high temperature" polymer which will not deform significantly or melt at fluid medium temperatures of about 120–180° F. and coil temperatures of about 450–650° F. Thermoplastic polymers having a melting temperature greater than 200° F., and preferably greater than the coil temperature, are most desirable, although certain ceramics and thermosetting polymers could also be useful for this purpose. Preferred thermoplastic material can include: fluorocarbons, polyaryl-sulphones, polyimides, bismaleimides, polypathalamides, polyetheretherketones, polyphenylene sulphides, polyether sulphones, and mixtures and copolymers of these thermoplastics. Thermosetting polymers which would be acceptable for such applications include polyimides, certain epoxies, phenolics, and silicones. Liquid-crystal polymers ("LCPs") can also be employed for improving high temperature properties.

In the preferred embodiment of this invention, polyphenylene sulphide ("PPS") is most desirable because of its elevated temperature service, low cost and easier processability, especially during injection molding.

The polymers of this invention can contain up to about 5–60 wt. % fiber reinforcement. Fiber reinforcing thermoplastics and thermosets dramatically increase the strength. For example, short glass fibers at about 30 wt. % loading boost tensile strength of engineering plastics by a factor of about two. Preferred fibers include chopped glass, such as E-glass or S-glass, boron, aramid, such as Kevlar 29 or 49, graphite and carbon fibers including high tensile modulus graphite. Other desirable fibers include heat-treated polyphenylene benzobisthiazole (PBT) and polyphenylene benzobisoxozole (PBO) fibers and 2% strain carbon/graphite fibers.

These polymers can be mixed with various other additives for improving thermal conductivity and mold-release properties. Thermal conductivity can be improved with the addition of metal oxides, nitrides, carbonates or carbides (hereinafter sometimes referred to as "ceramic additives"), and low concentrations of carbon or graphite. Such additives can be in the form of powder, flake or fibers. Good examples include oxides, carbides, carbonates, and nitrides of tin, zinc, copper, molybdenum, calcium, titanium, zirconium, boron, silicon, yttrium, aluminum or magnesium, or, mica, glass ceramic materials or fused silica.

Loadings in the polymer matrix for these thermally conducting materials are preferably within a range of about 60 and 200 parts of additive to 100 parts of resin ("PPH"), and more preferably about 80–180 PPH. These additives are generally non-electrically conductive, although conductive additives, such as metal fibers and powder flakes, of metals such as stainless steel, aluminum, copper or brass, and higher concentrations of carbon or graphite, could be used if thereafter overmolded, or coated, with a more electrically insulated polymeric layer. If an electrically conductive additive is employed, care must be given to electrically insulate the core to prevent shorting between the coils.

It is important, however, that the above additives are not used in excess, since an overabundance of fiber reinforcement or metal or metal oxide additives have been known to impair molding operations. Any of the polymeric elements of this invention can be made with any combination of these materials, or selective ones of these polymers can be used with or without additives for various parts of this invention depending on the end-use for the element.

This invention specifically contemplates that many combinations of polymeric resin, glass fiber and differing thermally-conductive fillers in various percentages will be employed in polymeric compositions to provide desirable thermal conductivity values for heating elements of various wattage ratings. Besides reinforcements and thermally conductive fillers, the plastic compositions of this invention can also contain mold-release additives, impact modifiers, and thermo-oxidative stabilizers which not only enhance the performance of plastic parts and extend the life of the heating element, but also aide in the molding process.

The compositions listed in Table 1 below were prepared by compounding polyphenylene sulfide with the stated amounts of aluminum oxide, magnesium oxide, and chopped glass fiber, according to methods well-known in the art. Pellets of these materials were injection molded to produce ASTM test specimens which were tested according to ASTM procedures to provide the tensile strength, flexural strength, flexural modulus, and notched-izod impact data shown in Table 1. Thermal conductivity values were similarly obtained.

It was found that the comparative Example 1 had a thermal conductivity too low to be useful in water heating elements. When material from Example 8, which had the highest thermal conductivity, was injection overmolded onto a wound core to form the water heating element of this invention, cracking and breakage occurred for wall thicknesses under 0.030 inches. However, wall thicknesses greater than 0.030 inches will enable such higher loadings. This is evidence that the tensile and flexural strength, as well as the impact strength, are adversely influenced by the addition of powdered ceramic additives, but variations in element design and resins can be used to overcome the effects of high loadings.

Ideally the tensile strength of the polymeric coating should be at least about 7,000 psi and preferably about 7,500–10,000 psi provided that satisfactory thermal conductivity is maintained. The flexural modulus at operating temperatures should be at least about 500 Kpsi, and preferably greater than 1000 Kpsi.

Finally, of all the materials from Table 1, it was found that those materials corresponding to Examples 6 and 7 were most suitable for water heating elements because they had the best balance of structural and thermal conductivity properties. Of course, ceramic loadings of about 60–200 PPH are meant to increase thermal conductivity as much as possible without interfering with molding operations. The thermal conductivity of the resulting coating should be at least about 0.5 W/m °K, preferably about 0.7 W/m °K, and ideally greater than about 1 W/m °K.

These compositions are presented by way of example, and not by way of limitation. However, to one skilled in the art, it should be clear that there are innumerable combinations of various conductive fillers with reinforcing fibers in resins which can also be optimized to perform suitably in the device of this invention. Such combinations could include high temperature LCP or PEEK resin with boron nitride and chopped glass additives, for example, or if cost is an issue, a PPS resin and $Al_2O_3$, or MgO, and chopped glass additives.

Figure 8:
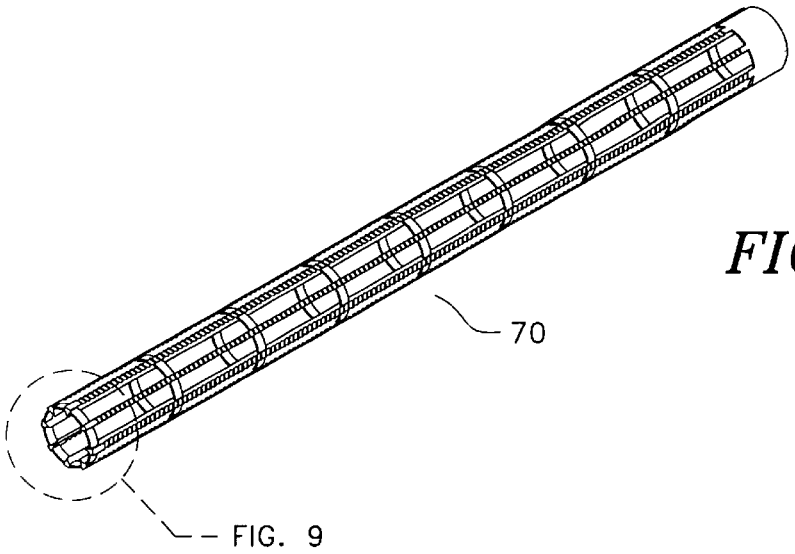
Figure 9:
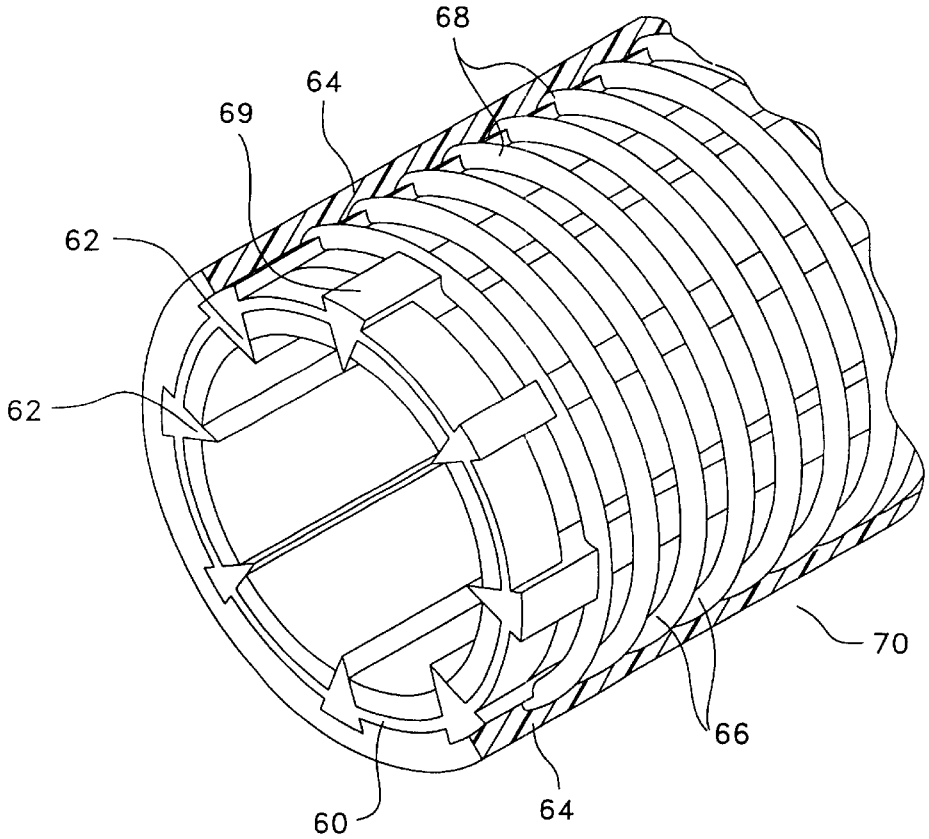

As an alternative to the preferred inner mold 300 of this invention, a skeletal support frame 70, shown in FIGS. 8 and 9 has been demonstrated to provide additional benefits. When a solid inner mold 300, such as a tube, was employed in injection molding operations, improper filling of the mold sometimes occurred due to heater designs requiring thin wall thicknesses of as low as 0.025 inches, and exceptional lengths of up to 14 inches. The thermally-conductive polymer also presented a problem since it desirably included additives, such as glass fiber and ceramic powder, aluminum oxide ($Al_2O_3$) and magnesium oxide (MgO), which caused the molten polymer to be extremely viscous. As a result, excessive amounts of pressure were required to properly fill the mold, and at times, such pressure caused the mold to open.

TABLE 1

| | Comparative Example 1 | Example 2 | Example 3 | Example 4 | Example 5 | Example 6 | Example 7 | Example 8 |
|---|---|---|---|---|---|---|---|---|
| Aluminum Oxide (PPH*) | — | 44 | — | — | 37 | 69 | 129 | 208 |
| Magnesium Oxide (PPH*) | — | — | 34 | 82 | — | — | — | — |
| Glass Fiber (PPH*) | 25 | — | 34 | 41 | 47 | 57 | 25 | 35 |
| Tensile strength (psi) | 16,900 | 9,800 | 11,600 | 8,500 | 14,400 | 13,600 | 10,300 | 7,800 |
| Flexural strength (psi) | 26,600 | 16,500 | 19,300 | 15,800 | 20,500 | 20,200 | 16,300 | 10,900 |
| Flexural Modulus (Kpsi, 25° C.) | 1,130 | 800 | 1,350 | 1,790 | 1,600 | 1,900 | 1,750 | 2,430 |
| Notched Izod (ft-lb/in) | 1.08 | 0.40 | 0.52 | 0.44 | 0.53 | 0.50 | 0.31 | 0.25 |
| Thermal conductivity (W/m. ° K.) | 0.24 | 0.36 | 0.37 | 0.61 | 0.40 | 0.51 | 0.84 | 1.2 |

*All Additive measurements are in parts per hundred parts of polyphenylene sulfide matrix With the use of the foregoing polymeric materials of this invention, it is possible to coat the metal sheath of conventional electric resistance heating elements to avoid many of the problems previously experienced with such elements. Such sheaths have been known to include copper and stainless steel. Additionally, this invention envisions using non-corrosion resistant materials for the sheath, such as carbon steel. For corrosion-resistant materials, the coating should be relatively thinner than for non-corrosion resistant materials, and this should require coatings of at least about 10 mils and higher thermal conductivity values.

Figure 13:
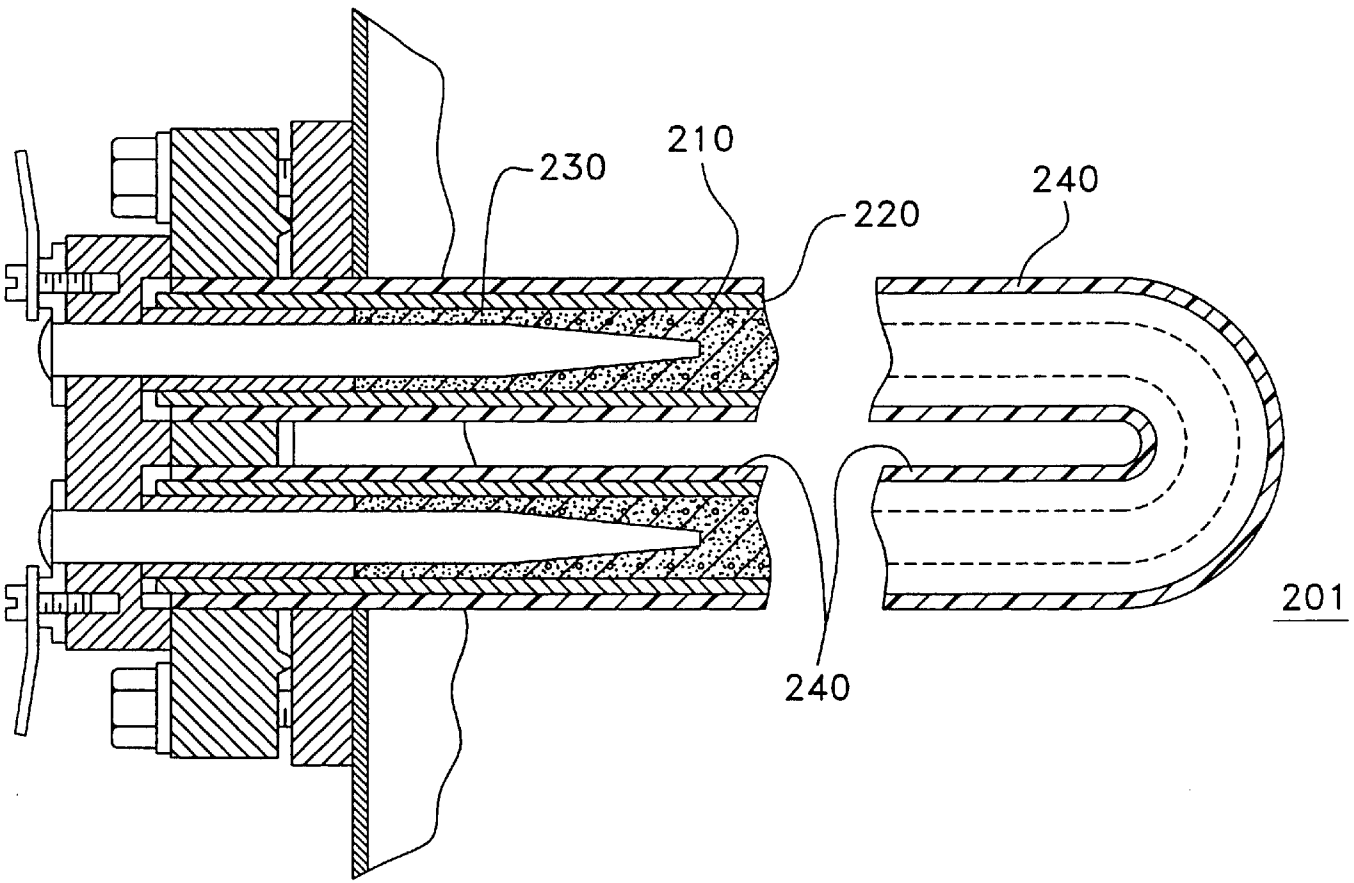

An improved version of a conventional electric resistance heating element 201, is shown in FIG. 13. This element 201 has a resistance heating wire disposed axially through a U-shaped tubular metal sheath 220 with powdered ceramic material 230 between the wire 210 and the metal sheath 220. The sheath 220 is then coated with a highly thermally conductive polymeric coating 240 of this invention to prevent galvanic currents occurring between the metal sheath and any exposed anodic metal components of the system. The excellent thermal conductivity of the polymeric materials, particularly with the additives disclosed herein, permits the heating elements to attain the high wattage ratings necessary to heat water efficiently to temperatures in excess of 120° without melting the coating.

The polymeric coating can be applied to the metal sheath, containing, for example, copper, brass, stainless steel, or carbon steel, either by injection molding or by dip coating the metal sheath in a fluidized bed of pelletized or powderized polymer, such as the PPS, PEEK, LCD, etc.

The resistance material used to conduct electrical current and generate heat in the fluid heaters of this invention preferably contains a resistance metal which is electrically conductive, and heat resistant. A popular metal is Ni—Cr alloy although certain copper, steel and stainless-steel alloys could be suitable. It is further envisioned that conductive polymers, containing graphite, carbon or metal powders or fibers, for example, used as a substitute for metallic resistance material, so long as they are capable of generating sufficient resistance heating to heat fluids, such as water. The remaining electrical conductors of the preferred polymeric fluid heater 100 can also be manufactured using these conductive materials.

In order to minimize the incidence of such problems, this invention contemplates using a skeletal support frame 70 having a plurality of openings and a support surface for retaining resistance heating wire 66. In a preferred embodiment, the skeletal support frame 70 includes a tubular member having about 6–8 spaced longitudinal splines 69 running the entire length of the frame 70. The splines 69 are held together by a series of ring supports 60 longitudinally spaced over the length of the tube-like member. These ring supports 60 are preferably less than about 0.05 inches thick, and more preferably about 0.025–0.030 inches thick. The splines 69 are preferably about 0.125 inches wide at the top and desirably are tapered to a pointed heat transfer fin 62. These fins 62 should extend at least about 0.125 inches beyond the inner diameter of the final element after the polymeric coating 64 has been applied, and, as much as 0.250 inches, to effect maximum heat conduction into fluids, such as water.

The outer radial surface of the splines 69 preferably include grooves which can accommodate a double helical alignment of the preferred resistance heating wire 66.

Although this invention describes the heat transfer fins 62 as being part of the skeletal support frame 70, such fins 62 can be fashioned as part of the ring supports 60 or the overmolded polymeric coating 64, or from a plurality of these surfaces. Similarly, the heat transfer fins 62 can be provided on the outside of the splines 69 so as to pierce beyond the polymeric coating 64. Additionally, this invention envisions providing a plurality of irregular or geometrically shaped bumps or depressions along the inner or outer surface of the provided heating elements. Such heat transfer surfaces are known to facilitate the removal of heat from surfaces into liquids. They can be provided in a number of ways, including injection molding them into the surface of the polymeric coating 64 or fins 62, etching, sandblasting, or mechanically working the exterior surfaces of the heating elements of this invention.

In a preferred embodiment of this invention, the skeletal support frame 70 includes a thermoplastic resin, which can be one of the "high temperature" polymers described herein, such as polyphenylene sulphide ("PPS"), with a small amount of glass fibers for structural support, and optionally ceramic powder, such as $Al_2O_3$ or MgO, for improving thermal conductivity. Alternatively, the skeletal support frame can be a fused ceramic member, including one or more of alumina silicate, $Al_2O_3$, MgO, graphite, $ZrO_2$, $Si_3N_4$, $Y_2O_3$, SiC, $SiO_2$, etc., or a thermoplastic or thermosetting polymer which is different than the "high temperature" polymers suggested to be used with the coating 30. If a thermoplastic is used for the skeletal support frame 70 it should have a heat deflection temperature greater than the temperature of the molten polymer used to mold the coating 30.

The skeletal support frame 70 is placed in a wire winding machine and the preferred resistance heating wire 66 is folded and wound in a dual helical configuration around the skeletal support frame 70 in the preferred support surface, i.e. spaced grooves 68. The fully wound skeletal support frame 70 is thereafter placed in the injection mold and then is overmolded with one of the preferred polymeric resin formulas of this invention. In one preferred embodiment, only a small portion of the heat transfer fin 62 remains exposed to contact fluid, the remainder of the skeletal support frame 70 is covered with the molded resin on both the inside and outside, if it is tubular in shape. This exposed portion is preferably less than about 10 percent of the surface area of the skeletal support frame 70.

The open cross-sectional areas, constituting the plurality of openings of the skeletal support frame 70, permit easier filling and greater coverage of the resistance heating wire 66 by the molded resin, while minimizing the incidence of bubbles and hot spots. In preferred embodiments, the open areas should comprise at least about 10 percent and desirably greater than 20 percent of the entire tubular surface area of the skeletal support frame 70, so that molten polymer can more readily flow around the support frame 70 and resistance heating wire 66.

Figure 11:
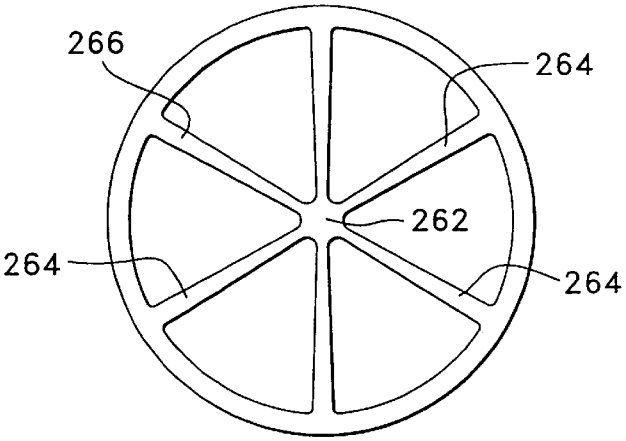
Figure 10:
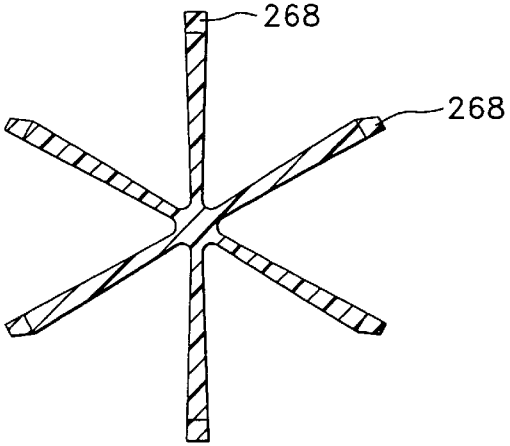
Figure 12:
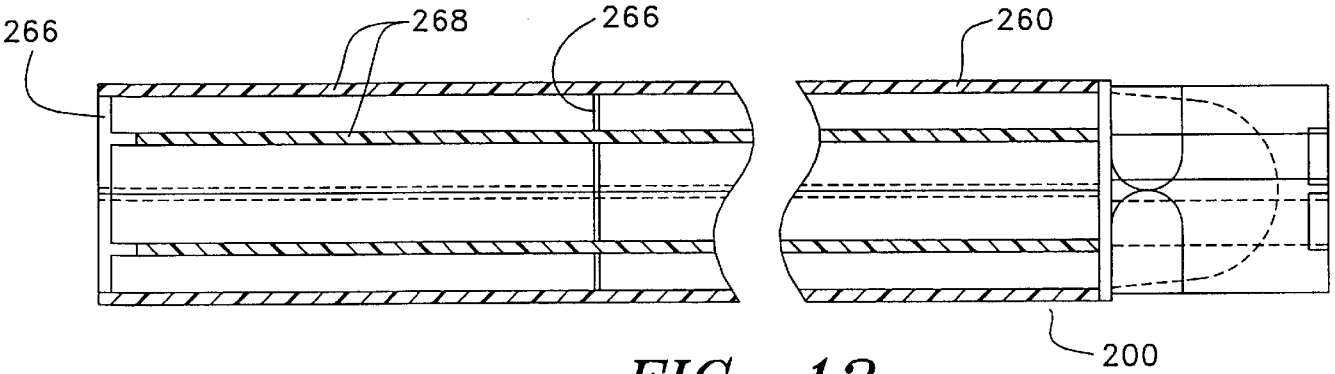

An alternative skeletal support frame 200 is illustrated in FIGS. 10–12. The alternative skeletal support frame 200 also includes a plurality of longitudinal splines 268 having spaced grooves 260 for accommodating a wrapped resistance heating wire (not shown). The longitudinal splines 268 are preferably held together with spaced ring supports 266. The spaced ring supports 266 include a "wagon wheel" design having a plurality of spokes 264 and a hub 262. This provides increased structural support over the skeletal support frame 70, while not substantially interfering with the preferred injection molding operations.

Alternatively, the polymeric coatings of this invention can be applied by dipping the disclosed skeletal support frames 70 or 200 and wire wound core 10, for example, in a fluidized bed of pelletized or powderized polymer, such as PPS. In such a process, the resistance wire should be wound onto the skeletal supporting surface, and energized to create heat. If PPS is employed, a temperature of at least about 500° F. should be generated prior to dipping the skeletal support frame into the fluidized bed of pelletized polymer. The fluidized bed will permit intimate contact between the pelletized polymer and the heated resistance wire so as to substantially uniformly provide a polymeric coating entirely around the resistance heating wire and substantially around the skeletal support frame. The resulting element can include a relatively solid structure, or have a substantial number of open cross-sectional areas, although it is assumed that the resistance heating wire should be hermetically insulated from fluid contact. It is further understood that the skeletal support frame and resistance heating wire can be pre-heated, rather than energizing the resistance heating wire, to generate sufficient heat for fusing the polymer pellets onto its surface. This process can also include post-fluidized bed heating to provide a more uniform coating. Other modifications to the process will be within the skill of current polymer technology.

The standard rating of the preferred polymeric fluid heaters of this invention used in heating water is 240 V and 4500 W, although the length and wire diameter of the conducting coils 14 can be varied to provide multiple ratings from 1000 W to about 6000 W, and preferably between about 1700 W and 4500 W. For gas heating, lower wattages of about 100–1200 W can be used. Dual, and even triple wattage capacities can be provided by employing multiple coils or resistance materials terminating at different portions along the active element portion 10.

From the foregoing, it can be realized that this invention provides improved fluid heating elements for use in all types of fluid heating devices, including water heaters and oil space heaters. The preferred devices of this invention are mostly polymeric, so as to minimize expense, and to substantially reduce galvanic action within fluid storage tanks. In certain embodiments of this invention, the polymeric fluid heaters can be used in conjunction with a polymeric storage tank so as to avoid the creation of metal ion-related corrosion altogether.

Alternatively, these polymeric fluid heaters can be designed to be used separately as their own storage container to simultaneously store and heat gases or fluid. In such an embodiment, the flow-through cavity 11 could be molded in the form of a tank or storage basin, and the heating coil 14 could be contained within the wall of the tank or basin and energized to heat a fluid or gas in the tank or basin. The heating devices of this invention could also be used in food warmers, curler heaters, hair dryers, curling irons, irons for clothes, and recreational heaters used in spas and pools.

This invention is also applicable to flow-through heaters in which a fluid medium is passed through a polymeric tube containing one or more of the windings or resistance materials of this invention. As the fluid medium passes through the inner diameter of such a tube, resistance heat is generated through the tube's inner diameter polymeric wall to heat the gas or liquid. Flow-through heaters are useful in hair dryers and in "on-demand" heaters often used for heating water.

Although various embodiments have been illustrated, this is for the purpose of describing and not limiting the invention. Various modifications, which will become apparent to one skilled in the art, or within the scope of this in the attached claims.

We claim:

1. An electrical resistance heating element for use in connection with heating a fluid medium, comprising:

(a) an element body having a supporting surface thereon;

(b) a resistance wire wound onto said supporting surface and connected to at least a pair of terminal end portions of said element; and (c) a thermally-conductive polymeric coating disposed over said resistance wire and said supporting surface for hermetically encapsulating and electrically insulating said resistance wire from said fluid, said polymeric coating comprising a thermally-conductive, non-electrically conducting ceramic additive.

2. The heating element of claim 1 wherein said polymeric coating has a thermal conductivity value of at least about 0.5 W/m °K.

3. The heating element of claim 2 wherein said polymeric coating comprises a thermoplastic resin having a melting point greater than 200° F.

4. The heating element of claim 3 wherein said polymeric coating comprises a fiber reinforcement.

5. The heating element of claim 4 wherein said fiber reinforcement comprises glass, boron, graphite, aramid or carbon fibers.

6. The heating element of claim 1 wherein said ceramic additive comprises a nitride, oxide or carbide.

7. The heating element of claim 6 wherein said polymeric coating comprises a loading of about 60–200 parts of said ceramic additive per hundred parts of the polymer in said polymeric coating.

8. The heating element of claim 7 wherein said polymeric coating is injection molded.

9. The heating element of claim 1, wherein said resistance wire is completely encapsulated within said polymeric coating during a molding operation.

10. A water heater comprising:

(a) a tank for containing water;

(b) a heating element attached to a wall of said tank for providing electric resistance heating to a portion of the water in said tank, said heating element comprising:

a support frame;

a resistance wire wound onto said support frame and connecting to at least a pair of terminal end portions; and a thermally-conductive polymeric coating disposed over said resistance wire and a major portion of said support frame for hermetically encapsulating and electrically insulating said resistance wire from said fluid, said polymeric coating including a thermally conductive, non-electrically conducting additive for providing a thermal conductivity value of at least about 0.5 W/m °K.

11. The water heater of claim 10 wherein said polymeric coating comprises a fibrous additive for improving mechanical strength and said thermally conductive, non-electrically conductive additive comprising a ceramic additive containing a nitride, carbide or oxide.

12. A method of manufacturing an electrical resistance element for heating a fluid, comprising:

(a) providing a support frame;

(b) winding a resistance heating wire onto said support frame;

(c) applying a thermally-conductive, non-electrically conductive, polymer over said resistance heating wire and a substantial portion of said support frame to electrically insulate and hermetically encapsulate said wire from said fluid, said thermally-conductive polymeric coating having a thermal conductivity value of at least about 0.5 W/m °K.

13. The method of claim 12 wherein said applying step (c) comprises injection molding.

14. The method of claim 13 wherein said thermally conductive polymer coating comprises about 60–200 parts of a ceramic additive per hundred parts of said polymer.

15. The method of claim 12 wherein said polymeric coating comprises a thermoplastic resin, a ceramic powder, and chopped glass fibers.

16. The method of claim 15 wherein said thermoplastic resin comprises PPS, and said thermal conductivity value is greater than about 0.7 W/m °K.

17. The method of claim 15 wherein said thermoplastic resin comprises an LCP.

18. The method of claim 12 wherein said applying step (c) comprises dipping said resistance heating wire and said support frame into a fluidized bed.

19. An electrical resistance heating element capable of being disposed through a wall of a tank for use in connection with heating a fluid medium, comprising:

a. a polymeric support frame;

b. a resistance heating wire having a pair of free ends joined to a pair of terminal end portions, said resistance heating wire wound onto and supported by said support frame; and c. a non-electrically conductive, polymeric coating containing an electrically insulating, thermally-conductive ceramic additive for improving the thermal conductivity of said coating, said coating disposed over said resistance wire and a portion of said support frame for hermetically encapsulating and electrically insulating said resistance wire from said fluid, said polymeric coating having a thermal conductivity value of at least about 0.5 W/m °K.

20. The heating element of claim 19 wherein said ceramic additive comprises an oxide of aluminum or magnesium.

21. The heating element of claim 20 wherein said polymeric coating further comprises chopped glass fibers.

22. An electrical resistance heating element for use in connection with heating a fluid medium, comprising:

a. an element body having a supporting surface thereon;

b. a resistance wire wound onto said supporting surface and connected to at least a pair of terminal end portions of said element; and c. a thermally-conductive, non-electrically conductive, polymeric coating disposed over said resistance wire and a substantial portion of said supporting surface for hermetically encapsulating and electrically insulating said resistance wire from said fluid, said polymeric coating comprising a thermally-conductive, non-electrically conducting ceramic additive for achieving a thermal conductivity value of at least about 0.5 W/m °K through said coating.

23. An electric resistance heating element for use in connection with heating a fluid medium, comprising:

(a) an electrical resistance wire;

(b) a ceramic material surrounding and electrically insulating said wire;

(c) a metal sheath encasing said ceramic material and electrical resistance wire; and (d) a thermally conductive polymeric coating disposed over said metal sheath for hermetically encapsulating and electrically insulating said metal sheath from said fluid, said polymeric coating having a thermal conductivity of at least about 0.5 W/m °K.

24. An electric resistance heating element for use in connection with heating a fluid medium, comprising:

(a) an electrical resistance wire;

(b) a ceramic material surrounding and electrically insulating said wire;

(c) a metal sheath encasing said ceramic material and electrical resistance wire; and (d) a thermally conductive polymeric coating disposed over said metal sheath for hermetically encapsulating and electrically insulating said metal sheath from said fluid, said polymeric coating comprising a thermally-conductive, non-electrically conducting ceramic additive.

25. The heating element of claim 24 wherein said polymeric coating has a thermal conductivity value of at least about 0.5 W/m °K.

* * * * *